US006776257B1

(12) United States Patent
Shaya

(10) Patent No.: US 6,776,257 B1
(45) Date of Patent: Aug. 17, 2004

(54) SOUND-ATTENUATING MUFFLER HAVING REDUCED BACK PRESSURE

(75) Inventor: Zvi Shaya, Rishon Lezion (IL)

(73) Assignee: Silent Exhaust Systems Ltd., Ashkelon (IL)

( * ) Notice: Subject to any disclaimer, the term of this patent is extended or adjusted under 35 U.S.C. 154(b) by 0 days.

(21) Appl. No.: 10/436,054

(22) Filed: May 13, 2003

(51) Int. Cl.[7] ..... F01N 1/08
(52) U.S. Cl. ..... 181/272; 181/282; 181/264
(58) Field of Search ..... 181/272, 267, 181/282, 264, 269, 255, 268, 275, 281

(56) References Cited

U.S. PATENT DOCUMENTS

| | | | | | |
|---|---|---|---|---|---|
| 624,062 | A | | 5/1899 | Mattews et al. | |
| 1,081,348 | A | | 12/1913 | Unke et al. | |
| 1,184,431 | A | | 5/1916 | Dodge | |
| 1,772,589 | A | * | 8/1930 | Beamer | 181/265 |
| 2,071,351 | A | | 2/1937 | McNamara | |
| 2,239,549 | A | | 4/1941 | Chipley | |
| 2,325,905 | A | | 8/1943 | Caulfield | |
| 2,485,555 | A | | 10/1949 | Bester | |
| 2,667,940 | A | | 2/1954 | Gallihugh | |
| 2,971,599 | A | | 2/1961 | Tobias | |
| 3,029,895 | A | | 4/1962 | Lyon | |
| 3,029,896 | A | | 4/1962 | Lyon | |
| 3,589,469 | A | * | 6/1971 | Hasui et al. | 181/232 |
| 4,574,914 | A | | 3/1986 | Flugger | |
| 5,123,502 | A | * | 6/1992 | Flugger | 181/264 |
| 5,214,254 | A | * | 5/1993 | Sheehan | 181/241 |
| 5,444,197 | A | * | 8/1995 | Flugger | 181/264 |
| 5,925,857 | A | * | 7/1999 | Birkel et al. | 181/250 |
| 6,089,347 | A | * | 7/2000 | Flugger | 181/264 |
| 6,098,745 | A | * | 8/2000 | Zalben | 181/282 |
| 6,286,623 | B1 | | 9/2001 | Shaya | |

FOREIGN PATENT DOCUMENTS

| | | | | |
|---|---|---|---|---|
| EP | 355605 | A1 * | 2/1990 | F01N/1/00 |

* cited by examiner

*Primary Examiner*—Shih-Yung Hsieh
*Assistant Examiner*—Edgardo San Martin
(74) *Attorney, Agent, or Firm*—Mark M. Friedman

(57) ABSTRACT

A muffler for an internal combustion engine having: (a) a housing including: (i) an inlet opening formed for a flow of exhaust gas into the housing, (ii) an outlet opening formed for a discharge of exhaust gas from the housing, and (b) inner workings disposed within the housing, including: (i) a dome-shaped partition with a first end of the surface pointing toward the inlet opening, and widening out at a second end to form a base, the dome-shaped partition having at least two partition openings disposed between the first end and the second end of the exterior surface, wherein the dome-shaped partition is disposed within the housing such that substantially all of the exhaust gas is directed through the partition openings and into an interior of the dome-shaped partition, before being discharged through the outlet opening.

22 Claims, 7 Drawing Sheets

SOUND-ATTENUATING MUFFLER HAVING REDUCED BACK PRESSURE

FIELD AND BACKGROUND OF THE INVENTION

The present invention relates to sound-attenuating mufflers for internal combustion engines and, more particularly, to sound-attenuating mufflers generating reduced back pressure.

Numerous muffler constructions have been proposed for the attenuation of the sound component of an exhaust gas stream from an internal combustion engine. Such mufflers are designed towards achieving appreciable sound attenuation, but without substantially increasing the back pressure on the engine, which results in power loss, reduced engine efficiency, and higher fuel consumption.

In surveying the prior art, U.S. Pat. No. 4,574,914 to Flugger teaches that although the patent art contains various muffler constructions which purport to solve the problem of sound attenuation without undesirable back pressure, in reality these various structures have substantial performance deficiencies. It is well known to provide a divergently tapered centrally located conical partition for flow of gases around the partition to effect an expansion of the gases. Typical of such structures are the devices shown in U.S. Pat. Nos. 2,071,351, 2,239,549 and 2,971,599.

Some of these patented mufflers follow such an expansion partition or cone with a contraction or concentrating partition or baffle. Typical of such devices are the mufflers shown in U.S. Pat. Nos. 1,081,348, 2,667,940, 3,029,895 and 3,029,896. These mufflers, however, do significantly increase back pressure by causing the exhaust gases to reverse the direction of their flow axially as they attempt to pass beyond the concentrating or converging baffle. This flow reversal may be effective in sound attenuation, but it has been found to increase back pressure undesirably.

Even mufflers which employ alternating divergent and then convergent partitions have suffered from undesirable bulk and/or weight, inordinate complexity, or auxiliary flow channels or openings in the partitions which defeat sound attenuation. Typical of such mufflers are the mufflers set forth in U.S. Pat. Nos. 624,062, 1,184,431, 2,325,905 and 2,485,555.

Thus, U.S. Pat. No. 4,574,914 to Flugger concludes that while the successive outward deflection and then inward convergence of gases in a muffler is broadly known in the prior art, such prior art structures typically have partitions or baffle structures which induce undesirable back pressure, contain openings or passageways which diminish the sound attenuating effectiveness of the muffler, or require excessive length, diameter and/or weight.

The muffler disclosed in U.S. Pat. No. 4,574,914 to Flugger is a compact, sound-attenuating muffler for a high-performance internal combustion engine in which the muffler casing has an elongated transverse cross-section with a height dimension of only slightly larger than the height dimension of the inlet exhaust pipe and a width dimension in the range of about 2 to 4½ times the height dimension. The muffler includes a divergently tapering planar first partition which causes gases to be expanded only in a horizontal plane toward the side walls of the muffler and further includes a second partition formed to contract or converge the gases, in a horizontal plane toward a central opening. The first partition has a cup-shaped back surface so that contraction of the gases around the back side of the first partition is highly effective in attenuating sound, and both partitions are sloped in a direction toward the outlet from the muffler so as to minimize the generation of back pressure, which, purportedly, is not substantially greater than the back pressure in a straight pipe.

The muffler disclosed in U.S. Pat. No. 4,574,914 is designed explicitly for high-performance internal combustion engines for racing cars and the like. Although the back pressure generated by such mufflers is reported to produce a power loss of less than 2%, the sound level reduction associated with this power loss is from 130 db on the A scale to about 90 db on the A scale. A sound level of about 90 db on the A scale is completely unacceptable for common passenger vehicles and the like.

An improved muffler for an internal combustion engine having characteristically low back pressure and a pleasing sound is disclosed in my U.S. Pat. No. 6,286,623, which is incorporated by reference for all purposes as if fully set forth herein. The muffler includes an elongated housing having an inlet opening formed for the flow of exhaust gas into the housing and an outlet opening formed for the discharge of exhaust gas from the housing, and an inventive partition shaped like a hollow pyramid, disposed within the housing. The exterior surfaces of the pyramid are joined at a first end to form a pyramidal apex that points toward the inlet opening, and these surfaces extend at a second end to form a rugose base. The partition is disposed in the housing to form four distinct spaces between the rugose base and the housing for the flow of exhaust gas.

The reduced back pressure pleasing sound notwithstanding, there remains a recognized need for an exhaust system that further improves the sound attenuation while maintaining, and preferably reducing, the generation of back pressure. It would be of further advantage for the exhaust system to be of simple design, compact, lightweight, and easy to fabricate.

SUMMARY OF THE INVENTION

According to the teachings of the present invention there is provided a muffler for an internal combustion engine having characteristically low back pressure and a pleasing sound, the muffler having: (a) a housing including: (i) an inlet opening formed for a flow of exhaust gas into the housing, and (ii) an outlet opening formed for a discharge of exhaust gas from the housing; and (b) inner workings disposed within the housing, the inner workings including: (i) a dome-shaped partition having an exterior surface, a first end of the exterior surface pointing toward the inlet opening, and widening out at a second end to form a base, the dome-shaped partition having at least two partition openings disposed between the first end and the second end of the exterior surface, wherein the dome-shaped partition is disposed within the housing such that substantially all of the exhaust gas passing through the inlet opening is directed through the partition openings and into an interior of the dome-shaped partition, before being discharged through the outlet opening.

According to further features in the described preferred embodiments, the flow of the exhaust gas is deflected along the exterior surface in substantially all directions.

According to still further features in the described preferred embodiments, the partition openings are disposed in a side of the exterior surface.

According to still further features in the described preferred embodiments, the inner workings of the muffler further include: (ii) a converging partition having a flow outlet, the converging partition disposed within the housing such that the exhaust gas introduced through the partition openings and into the interior of the dome-shaped partition passes through the flow outlet.

According to still further features in the described preferred embodiments the exhaust gas passing through the inlet opening is directed along a main flow path towards the outlet opening, and wherein the inner workings are adapted such that the main flow path flow is solely in a positive orientation.

According to still further features in the described preferred embodiments, the inner workings are adapted such that any unidirectional flow regime within the housing bears solely a positive orientation.

According to still further features in the described preferred embodiments, the base of the dome-shaped partition is equipped with an outlet partition having an exhaust gas outlet for fluidly sealing the base, such that the exhaust gas introduced into the interior is discharged solely through the exhaust gas outlet.

According to still further features in the described preferred embodiments, with $H_1$ defined as a height of the domed partition, and $H_2$ defined as a height of at least one opening of the at least two partition openings, the ratio of $H_1$ to $H_2$ is less than 5 to 1.

According to still further features in the described preferred embodiments, with $H_1$ defined as a height of the domed partition, and $H_2$ defined as a height of at least one opening of the at least two partition openings, the ratio of $H_1$ to $H_2$ is at least 1.5 to 1.

According to still further features in the described preferred embodiments, the ratio of $H_1$ to $H_2$ is at least 2 to 1 and is less than 4 to 1.

According to still further features in the described preferred embodiments, the ratio of $H_1$ to $H_2$ is less than 3.5 to 1.

According to still further features in the described preferred embodiments, the ratio of $H_1$ to $H_2$ is at least 2.5 to 1 and is less than 3.5 to 1.

According to another aspect of the present invention there is provided a muffler for receiving and discharging an exhaust gas from an internal combustion engine, the muffler having: (a) a housing including: (i) an inlet opening formed for a flow of exhaust gas into the housing, and (ii) an outlet opening formed for a discharge of exhaust gas from the housing; and (b) inner workings disposed within the housing, the inner workings including: (i) a deflecting partition having an exterior surface, a first end of the exterior surface pointing toward the inlet opening, and widening out at a second end to form a base, the partition having at least two partition openings disposed between the first end and the second end of the exterior surface, wherein the partition is disposed within the housing such that substantially all of the exhaust gas passing through the inlet opening is deflected along the exterior surface and directed through the partition openings into an interior of the deflecting partition, before being discharged through the outlet opening.

According to still further features in the described preferred embodiments, the exterior surface is substantially convex.

According to still further features in the described preferred embodiments, the exterior surface is substantially hemi-spherical.

According to still further features in the described preferred embodiments, the exterior surface is substantially hemi-spheroidal.

According to still further features in the described preferred embodiments, the inner workings further include a guide trough, disposed along the exterior surface, for guiding the flow of the exhaust gas along the exterior surface and towards the partition openings.

The present invention successfully addresses the shortcomings of the existing technologies by providing a muffler that reduces back pressure appreciably relative to conventional mufflers of the prior art, including the muffler disclosed in my above-referenced patent, while achieving improved levels of sound attenuation. Moreover, the muffler of the present invention is of simple and reliable design, and is inexpensive to manufacture.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
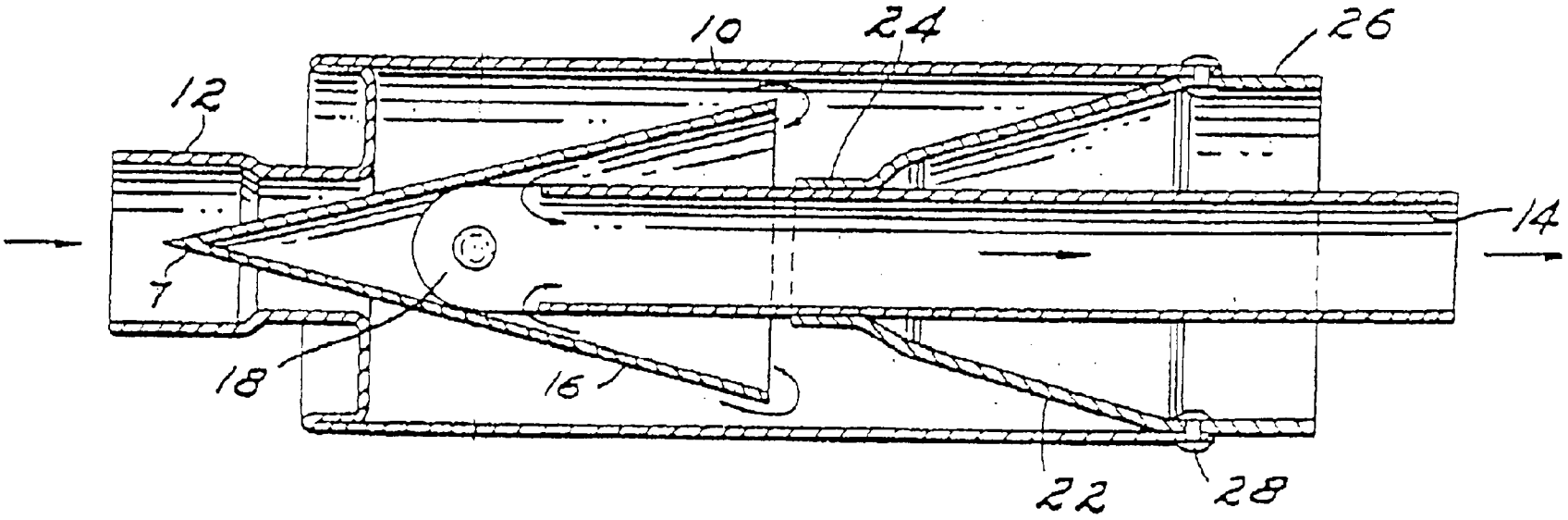
Fig. 1 (prior art)
FIG. 1 is a sectional view through a muffler embodying the prior art of U.S. Pat. No. 2,971,599 to Tobias.

The principles and operation of the muffler according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

FIG. 1 is a sectional view through a muffler embodying the prior art of U.S. Pat. No. 2,971,599 to Tobias, which is incorporated by reference for all purposes as if fully set forth herein. The muffler includes a housing 10 that is provided at one end with an inlet pipe 12. Inlet pipe 12 is of reduced diameter as compared with the diameter of the casing and is adapted to be coupled with an exhaust leading from the engine. There is a discharge pipe 14 which is shown as of substantially the same diameter as that portion of the inlet pipe 12 which enters the casing.

There is a tapered tubular baffle 16 that is supported within the casing between the inlet pipe 12 and the discharge pipe 14. The baffle shown is of a conical shape and closed at its reduced end 7. The reduced end 7 extends into the inlet pipe 12. The enlarged rear end of the baffle 16 surrounds and overlaps the adjacent end of the discharge pipe 14. It will be seen that the tubular baffle 16 is so fastened to the ears 18 of the discharge pipe 14 that a flow passageway is provided through the interior of the baffle 16 into the end of the discharge pipe between the ears 18.

Baffle 22 is a tubular tapered baffle generally in the form of a truncated cone. The small end of this baffle encircles and is connected with discharge pipe 14 at 24. The opposite flaring end 26 of this baffle 22 is connected by rivets 28 or the like with the discharge end of the casing 10. The second baffle 22 therefore constitutes a closure that extends from the inner wall of the casing 10 forwardly to the discharge pipe 14. In operation it will be seen that exhaust gas from the engine enters the casing through the inlet pipe 12, flows over the tapered end of the baffle 16 rearwardly within the casing and is directed by the baffle 22 to flow forwardly into the cone-shaped baffle 16. It will be seen that the cone-shaped baffle 16 overhangs for a substantial portion of its length the discharge pipe 14 and the exhaust gas entering the baffle 16 flows downwardly therethrough and into the discharge pipe between the ears 18. The exhaust gas is then discharged through the opposite end of the pipe 14.

U.S. Pat. No. 2,971,599 discloses that the flow of the exhaust gas is sufficiently smooth that a minimum of back pressure is set up within the baffle, while the gas stream is directed such that undesirable noise is effectively silenced.

It has been established by U.S. Pat. No. 4,574,914 to Flugger, however, that mufflers of this type significantly increase back pressure by causing the exhaust gases to reverse the direction of their flow axially as they attempt to pass beyond the concentrating or converging baffle. Although such flow reversal may be effective in sound attenuation, it has been found to increase back pressure undesirably.

Figure 2:
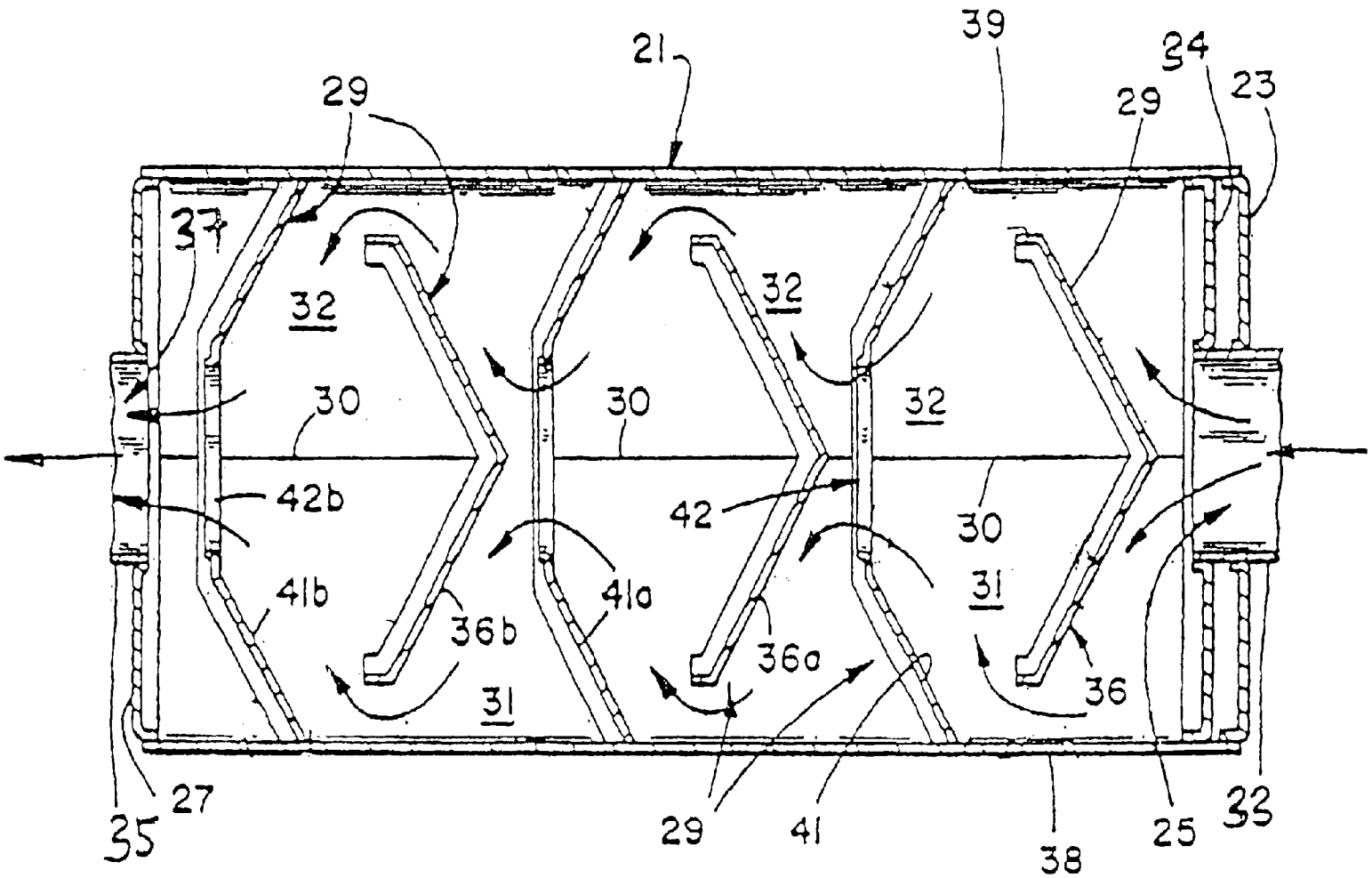
Fig. 2 (prior art)
FIG. 2 is a sectional view of a muffler for high-performance internal combustion engines, according to U.S. Pat. No. 4,574,914 to Flugger.

The muffler disclosed by U.S. Pat. No. 4,574,914, which is incorporated by reference for all purposes as if fully set forth herein, is a muffler for high-performance internal combustion engines. A sectional view of this prior art muffler is provided in FIG. 2. The muffler includes a casing, generally designated 21, an inlet pipe 22 extending through casing end wall members 23 and 24 for the flow of exhaust gases through inlet opening 25 into casing 21. The muffler further includes an outlet pipe 26 mounted to extend through casing end wall 27 and provide an outlet opening 28 for the discharge of gases from the casing. Mounted in casing 21 is partition means, generally designated 29, which is formed for the attenuation of the sound component in the exhaust gases as the gases pass through the muffler.

Partition means 29 includes a first partition 36 that is divergently tapered from the longitudinal center line of the casing, which coincides with seam 30 between casing halves 31 and 32. First partition 36 deflects gases passing through inlet opening 25 from inlet exhaust pipe 22 outwardly toward the side walls 38 and 39 of casing 21. Mounted downstream of partition 36 is a second partition 41, which is formed to be convergently tapered With respect to the central longitudinal axis of the muffler. Partition 41 is formed with central opening means 42 so that gases converging from walls 38 and 39 pass through central opening 42, at which point they are discharged from the casing or, as shown in the drawing, impact an additional first partition 36*a*. In the muffler shown in the drawing, the divergence and convergence of the exhaust stream is repeated when the exhaust gases are successfully deflected by an additional second partition 41*a*, still another first partitions 36*a*, and finally, an additional second partition 41*b*, which discharges the gases through opening 42*b* into outlet opening 28 and outlet exhaust pipe 26.

U.S. Pat. No. 4,574,914 to Flugger teaches a muffler that achieves extremely effective sound attenuation without undesirable back pressure and bulk or weight by forming casing 21 with a transverse cross section having a width dimension substantially greater than the height. U.S. Pat. No. 4,574,914 further discloses that the muffler includes three sets of first and second partitions. Each set of partitions attenuates the sound component in the exhaust gases by about ½ to ⅔ of the sound level in the incoming gases. Thus, three sets of partitions can be used to reduce the sound level on an 800 horsepower engine during maximum acceleration from about 130 db on the A scale (about 5,000 watts) to about 90 db on the A scale (about one tenth of a watt). It will be appreciated that a sound level of 90 db on the A scale is unacceptable for common passenger vehicles.

Figure 3:
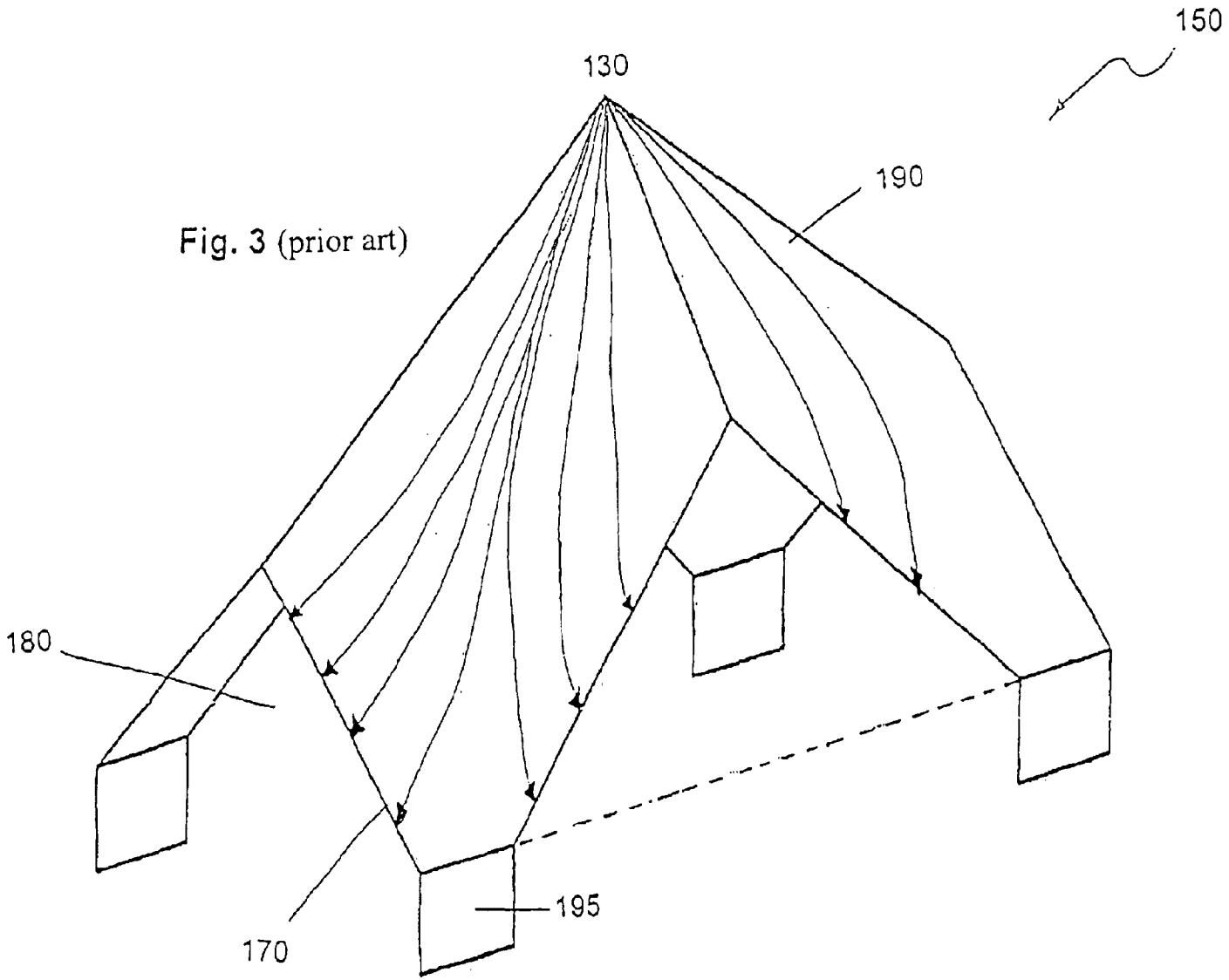
Fig. 3 (prior art)
FIG. 3 is a perspective view of a pyramidal partition according to my U.S. Pat. No. 6,286,623.

Referring now to the drawings of my above-referenced U.S. Patent, FIG. 3 is an illustration of the main partition, pyramidal partition 150. Pyramidal partition 150 has four faces (two shown), each face 190 meeting at apex 130. Pyramidal partition 150 is hollow, and the distal end of pyramidal partition 150 is provided with four spaces, each space 180 shaped like an inverted V, at 90° angles along the rugose base 170 of the partition 150. Also provided at the base of each facing are ears 195 for welding the partition 150 to the muffler housing (shown below in FIG. 4).

Figure 4:
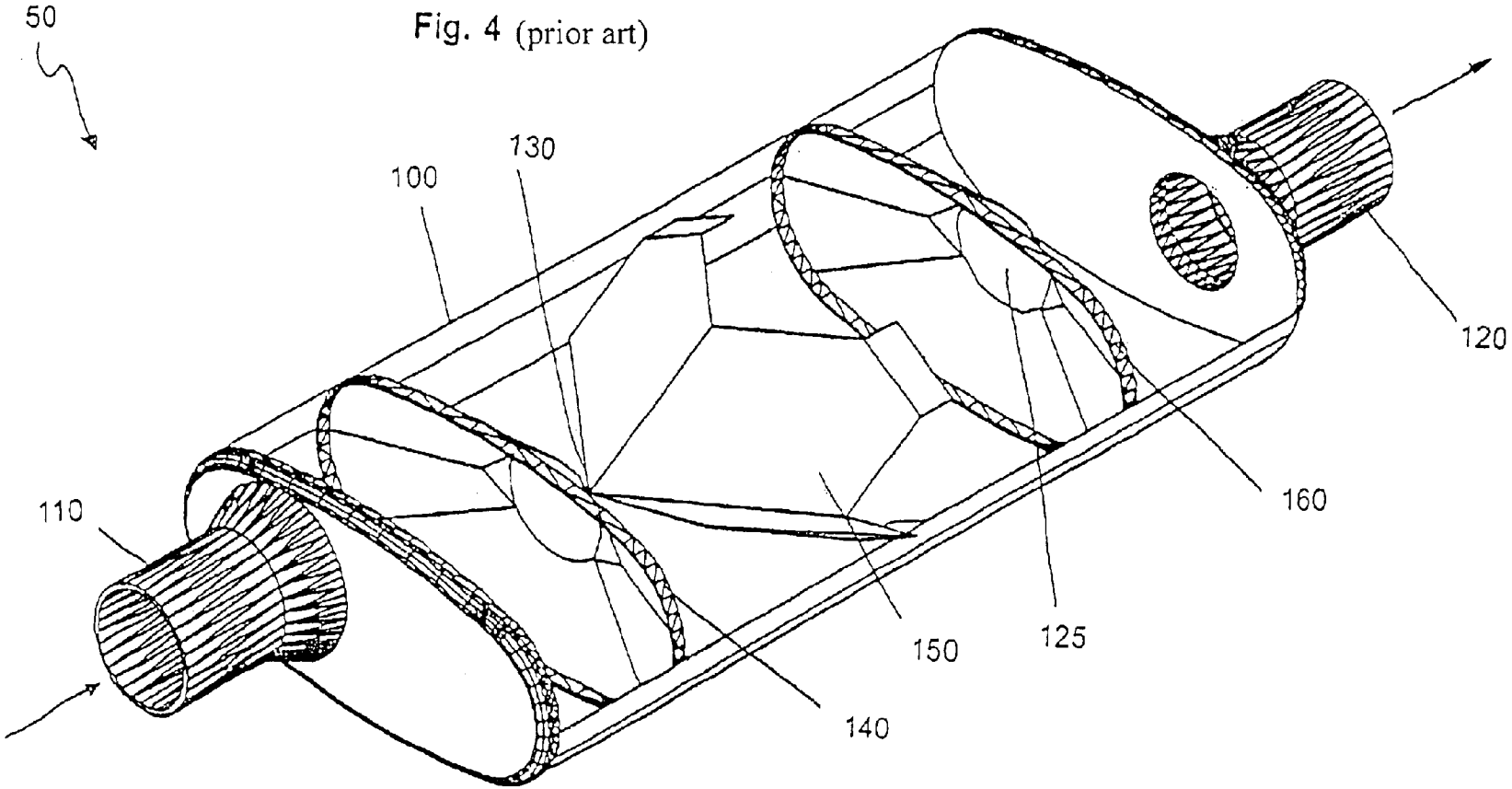
Fig. 4 (prior art)
FIG. 4 is a perspective, wire frame view of the muffler of FIG. 3.

A top view of the muffler 50 is shown in FIG. 4. Muffler 50 consists of an elongated housing 100 having an inlet 110 for introducing the exhaust gas, an outlet 120 for discharging the exhaust gas, the pyramidal partition 150 of FIG. 3, and converging partitions 140 and 160.

The exhaust gas from the internal combustion engine is introduced through the inlet 110, which is located towards one side of the short side of housing 100. The exhaust gas enters the housing 100 and flows through partition 140 in the long direction of the housing. Partition 140 is shaped like a funnel (or truncated pyramid), disposed such that the hollow base of the partition 140 faces the flow of exhaust gas. Thus, the exhaust gas flow is centered within the housing 100. The exhaust gas flow then meets the apex 130 of pyramidal partition 150, causing the flow to be deflected along the exterior faces 190 of pyramidal partition 150 and towards the interior wall of housing 100.

The exhaust gas flows into the four spaces formed by the rugose base (see also FIG. 3) of the pyramidal partition 150. A substantial portion of the exhaust gas continues to flow in the direction of the outlet pipe 120, thereby creating a low pressure region inside the pyramidal partition 150. Consequently, a second portion of the exhaust gases changes directions and enters (is drawn into) the inside of pyramidal partition 150 before continuing in the direction of the outlet pipe 120. The exhaust gases flow through converging partition 160, which is substantially identical in shape and in disposition to converging partition 140. Thus, the exhaust gas flow is centered within the housing 100 by the partition outlet 125 before being discharged through outlet pipe 120.

Partition 160 can be fabricated such that the partition outlet 125 is directly opposite the outlet pipe 130. Moreover, when the inlet pipe 110 is centrally disposed in the short side of housing 100, partition 140 is not necessary. Similarly, when the outlet pipe 120 is centrally disposed in the short side of housing 100 distal to the inlet pipe 110, partition 160 is not necessary.

Muffler 50 reduces back pressure appreciably relative to conventional mufflers of the prior art, while achieving satisfactory levels of sound attenuation. Referring back to FIG. 3, the sound attenuation achieved in the muffler 50 can be attributed to a number of factors, one of which is the change in direction of the gases flowing across the rugose base 170 of the pyramidal partition 150.

Although pyramidal partition 150 can be replaced with a conical shape having a rugose base, it is explicitly disclosed in my above-referenced patent that the performance of the pyramidal partition is appreciably better than that of a conical partition, i.e., for a given back pressure, the sound attenuation achieved and the quality of the tone emitted by the muffler are both considerably improved with respect to the sound attenuation and the tone quality achieved using the conical partition.

In my previous efforts to develop exhaust systems having improved performance, I observed that:

1. Known mufflers having conical partitions are capable of achieving the sound attenuation required for ordinary passenger vehicles, but at the cost of appreciable back pressure and reduced engine performance and efficiency. It may not be the conical partition geometry, per se, that causes the excessive back pressure, so much as the configuration that forces the entire exhaust gas flow to reverse direction through the inside of the cone.

2. When the muffler is configured like an ejector, in which a portion of the gas continues to flow in the direction of the outlet pipe, thereby creating a low pressure region inside the cup of the cone, the back pressure is greatly reduced.

In the continuing efforts to develop new exhaust systems having improved performance characteristics, I have observed that known mufflers that have ejector-type flow paths in which the bulk of the exhaust gas flows along the length of the muffler without undergoing flow reversal, generally exhibit relatively poor sound attenuation properties, unless additional sound attenuation units are introduced to the muffler assembly. Such additional sound attenuation units increase the material and fabrication costs of the muffler, arid perhaps more importantly, increase back-pressure and reduce engine performance. This concurs with a well-established principle of muffler design, namely, that there exists a trade-off between sound attenuation and back pressure.

Figure 5:
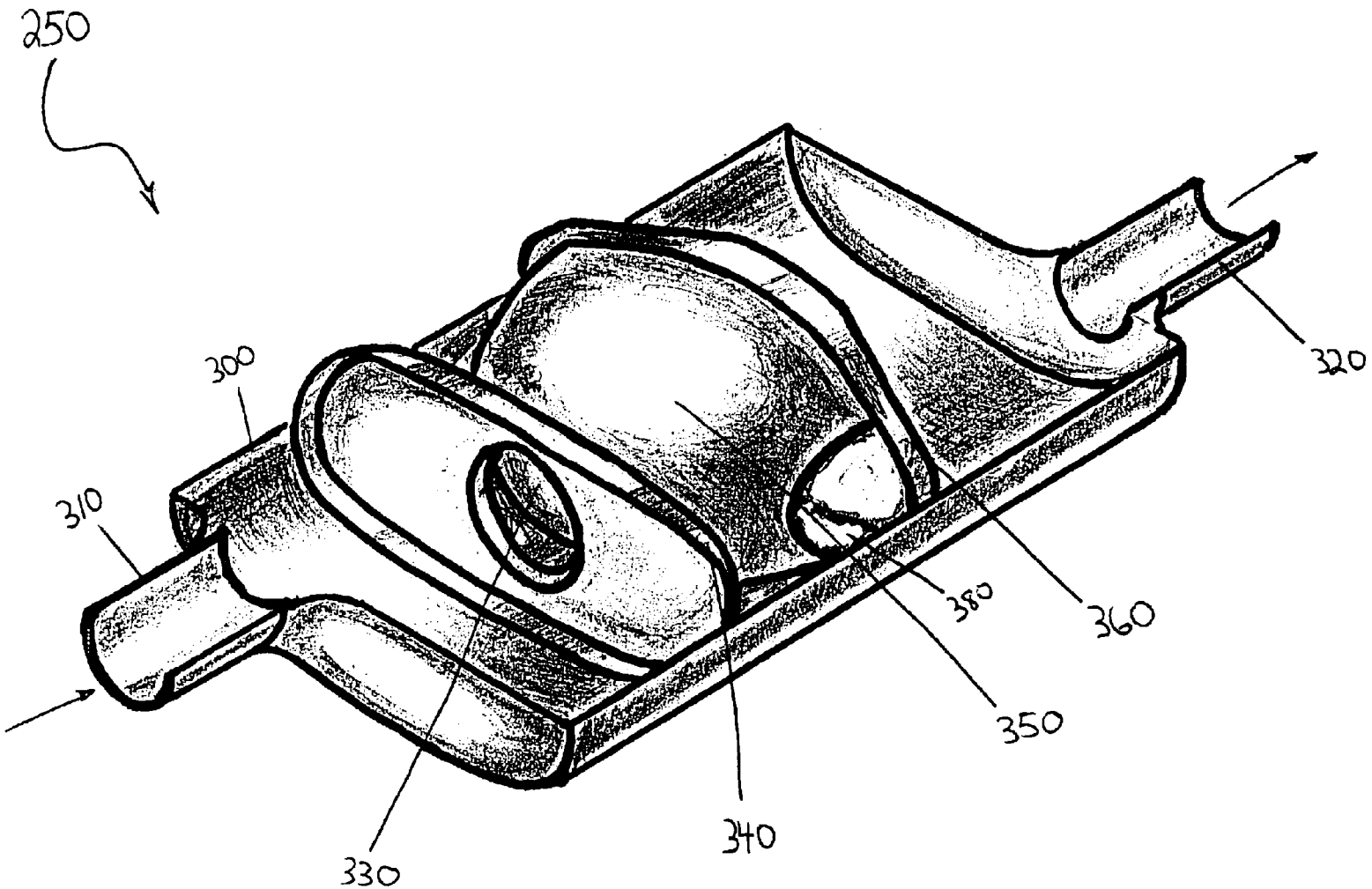
FIG. 5 is a perspective, cut-open view of the muffler of the present invention.

It was surprising, therefore, to discover a muffler design that provides improved sound attenuation while actually maintaining and even improving engine performance. Referring now to the figures depicting exemplary embodiments of the present invention, FIG. 5 shows a perspective, cut-open view of the muffler 250 of the present invention. Muffler 250 includes an elongated housing 300 having an inlet 310 for introducing the exhaust gas, an outlet 320 for discharging the exhaust gas, a main partition 350, and an aligning partition 340.

The exhaust gas from the internal combustion engine is introduced through the inlet 310, which is located towards one side of the short side of housing 300. It will be appreciated that when inlet pipe 310 is centrally disposed in the short side of housing 300, partition 340 is not necessary. The exhaust gas enters housing 300 and flows through partition 340 in the long direction of the housing. Partition 340 is preferably shaped like a funnel (or truncated pyramid), and most importantly, is disposed such that the exhaust gas flow is centered within the housing 300 such that the exhaust gas flow then meets the top 330 of domed partition 350, causing the flow to be deflected along the exterior face 390 (delineated in FIG. 6) of domed partition 350.

The exhaust gas flows into openings 380 in the side of domed partition 350, openings 380 preferably being disposed on opposite sides of domed partition 350 In sharp contrast to the teachings of U.S. Pat. No. 4,574,914 to Flugger and to the teachings of my above-referenced U.S. patent, housing 300 and domed partition 350 are adapted such that all, or substantially all of the exhaust gas is passed through the underside of partition 350.

Subsequently, the exhaust gas continues to flow in the direction of outlet pipe 320, thereby creating a low pressure region inside domed partition 350. Consequently, a portion of the exhaust gases changes directions and enters (is drawn into) the inside of domed partition 350 before continuing in the direction of outlet pipe 320. The exhaust gases flow through converging partition 360, which is advantageously similar in shape and in disposition to converging partition 340, before being discharged through outlet pipe 320. Partition 360 can be fabricated such that partition outlet 325 (shown in FIG. 7) is directly opposite outlet pipe 320.

Figure 6:
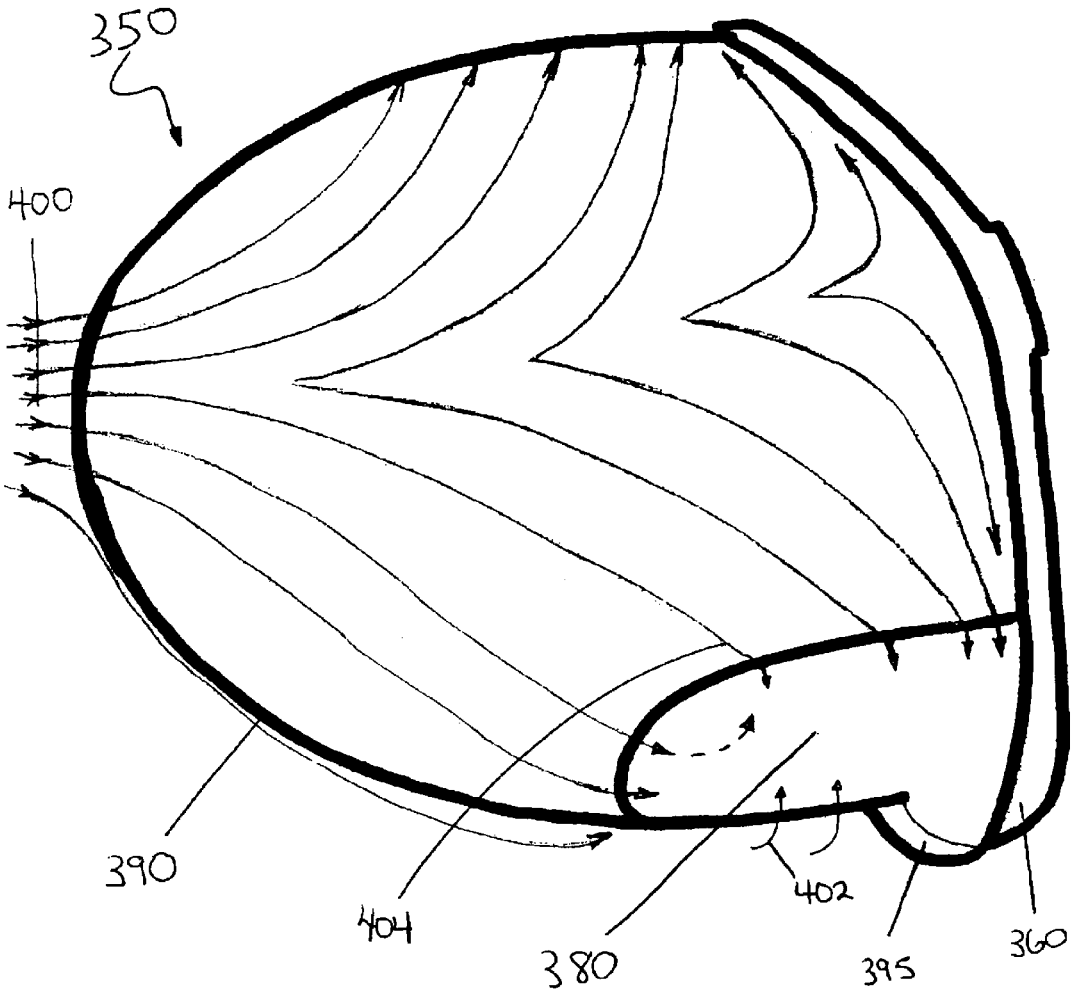
FIG. 6 is a schematic view of the inventive partition used in the muffler of FIG. 5, illustrating the exhaust gas flow path along the exterior surface of the dome-shaped partition.

FIG. 6 is a perspective view of the inventive domed partition 350 used in the muffler of FIG. 5. An exhaust gas flow 400, centered within housing 300, meets the rounded top of domed partition 350, causing the flow to be smoothly and gradually deflected along exterior face 390 of domed partition 350 and towards the interior wall of housing 300. All of exhaust gas flow 400 is directed through openings 380, one of which is shown in FIG. 6. It is observed that the directions of the flow in the vicinity of openings 380 are such that many of the flow vectors (e.g., flow vectors 402 and 404) are diametrically opposed, which is highly advantageous in destructively interfering with the associated sound waves, such that the sound volume is effectively reduced.

In a preferred embodiment, a guide trough 395, formed between the bottom of domed partition 350 and the inside face of converging partition 360, serves to guide the flow of exhaust gas along the long side of exterior face 390 such that a larger portion of the flow vectors (e.g., flow vectors 402 and 404) meet in a substantially diametrically opposed manner.

Figure 7:
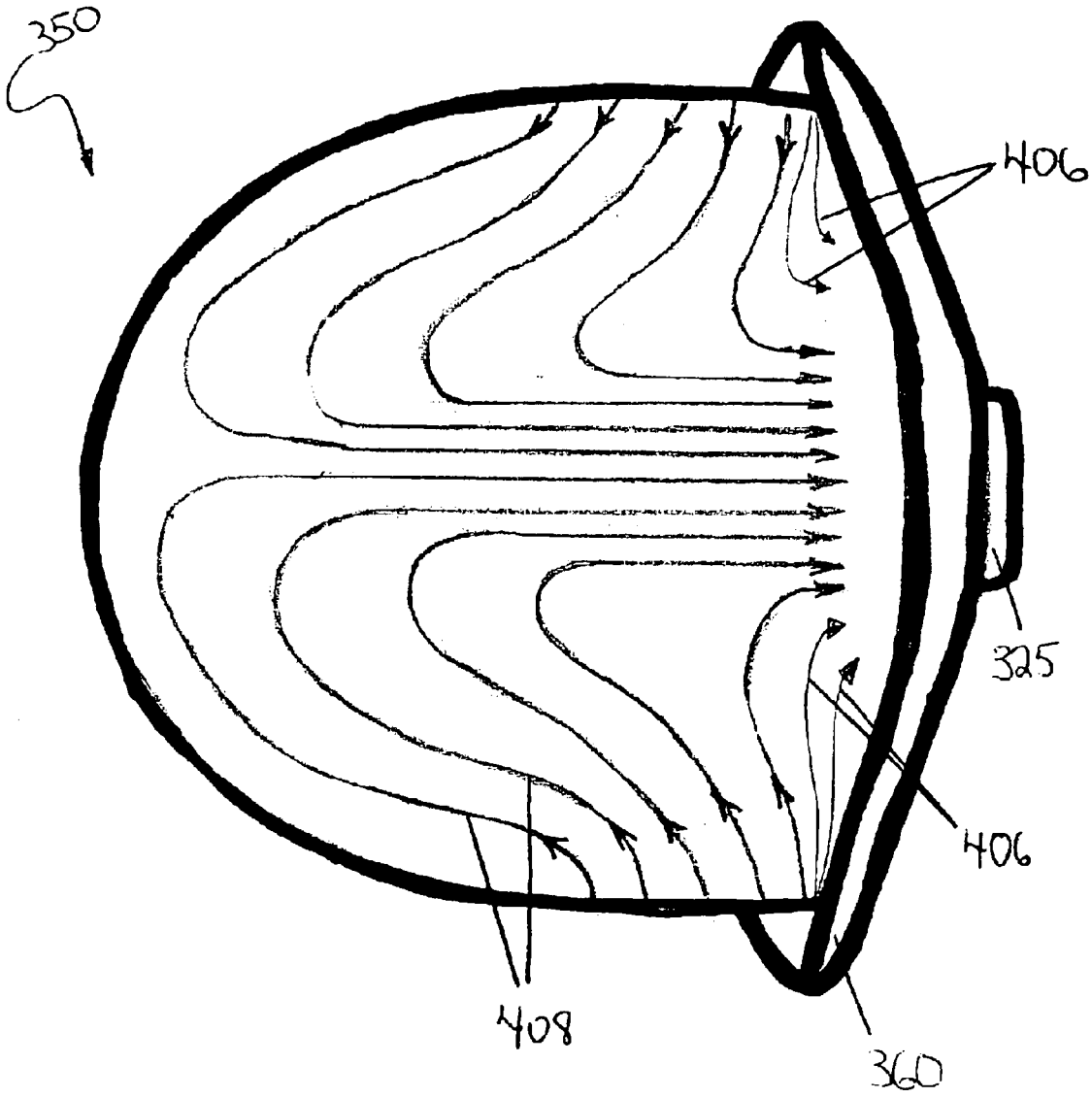
FIG. 7 is a schematic view of the inventive partition, illustrating the exhaust gas flow path within the dome-shaped partition.

The flow pattern of the gases, upon entering the underside of domed partition 350, is illustrated in FIG. 7. A first portion 406 of the exhaust gas flows substantially in the direction of partition outlet 325, thereby creating a low pressure region within domed partition 350. Consequently, a second portion 408 of the exhaust gas changes direction and enters (is drawn into) the inside of domed partition 350 before continuing in the direction of partition outlet 325. This greatly increase the mean flow path of the exhaust gases, which results, inter alia, in a further reduction of the sound volume.

It has been found, based on an experimental study, that a rounded dome is preferable to a partition having a pointed exterior facing, such as a cone. It has also been found that an elongated dome is preferable to a hemispheric dome.

Finally, it has been found that the height of domed partition 350, the height and cross-sectional area of openings 380, and the ratio between the height of domed partition 350 and the height of openings 380 are parameters of paramount importance in the performance of muffler 250.

If $H_1$ is the height of domed partition 350, i.e., the distance between the top 330 of domed partition 350 and the bottom of opening 380, and $H_2$ is the height of opening 380, the ratio $H_1$:$H_2$ should be under 5:1 and greater than 1.5:1. Preferably, ratio $H_1$:$H_2$ should be under 4:1 and greater than 2:1. Most preferably, ratio $H_1$:$H_2$ should be under 3.5:1 and greater than 2.5:1. Although the optimal ratio is influenced by the total cross-sectional area of openings 380, and by various parameters that are characteristic to individual engine models, the above-delineated height ratios have been found to be appropriate for a wide range of engine type and size.

As used herein in the specification and in the claims section that follows, the term "dome-shaped partition", and the like refer to a shell having a closed face for receiving the exhaust gas introduced to the muffler. Preferably, the shell is generally hemispheroidal or hemispheric.

As used herein in the specification and in the claims section that follows, the term "main flow path", and the like refer to a path, bounded by at least one wall, for the flow of exhaust gas within the muffler, and having a net flow across the cross-section of the path.

As used herein in the specification and in the claims section that follows, the term "positive orientation", and the like, used in conjunction with a flow of exhaust gas, refer to a flow direction that is in the general direction of flow between the exhaust gas inlet and the exhaust gas outlet of the muffler, or at the very least, to a flow direction that is within 90° of the flow direction between the exhaust gas inlet and the exhaust gas outlet of the muffler.

As used herein in the specification and in the claims section that follows, the term "unidirectional" and the like, used in conjunction with a flow of exhaust gas, refer to a flow of exhaust gas within a simply bounded region that is substantially directed in a single direction.

EXAMPLES

Reference is now made to the following examples, which together with the above description, illustrate the invention in a non-limiting fashion.

Example 1 (Comparative)

A performance test was performed on a passenger vehicle having a muffler of the design disclosed in my above-referenced U.S. patent. The main partition is pyramidal, with the apex facing the exhaust gas inlet. The thrust, or pushing force, measured on the wheels, was 180 kg. The power, as measured on the wheels, was 51.4 HP.

Example 2

A performance test was performed on the passenger vehicle of Example 1, but having a muffler of the present invention. The main partition is dome-shaped, with the rounded exterior facing the exhaust gas inlet. The thrust, measured on the wheels, was 195 kg. The power, as measured on the wheels, was 54.0 HP. The performance of the engine (both in terms of thrust and power), in conjunction with the inventive muffler, was superior even to the performance of the engine in conjunction with the highly-efficient muffler of the prior art. Surprisingly, the noise level emanating from the inventive muffler was actually reduced with respect to the muffler of the prior art.

Although the invention has been described in conjunction with specific embodiments thereof, it is evident that many alternatives, modifications and variations will be apparent to those skilled in the art. Accordingly, it is intended to embrace all such alternatives, modifications and variations that fall within the broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A muffler for receiving and discharging an exhaust gas from an internal combustion engine, the muffler comprising:

(a) a housing including:

(i) an inlet opening formed for a flow of exhaust gas into said housing, and (ii) an outlet opening formed for a discharge of exhaust gas from said housing; and (b) inner workings disposed within said housing, said inner workings including:

(i) a dome-shaped partition having an exterior surface, a first end of said exterior surface pointing toward said inlet opening, and widening out at a second end to form a base, said dome-shaped partition having at least two partition openings disposed between said first end and said second end of said exterior surface, wherein said dome-shaped partition is disposed within said housing such that substantially all of said exhaust gas passing through said inlet opening is directed through said partition openings and into an interior of said dome-shaped partition, before being discharged through said outlet opening.

2. The muffler of claim 1, wherein the flow of the exhaust gas is deflected along said exterior surface in substantially all directions.

3. The muffler of claim 1, wherein said openings are disposed in a side of said exterior surface.

4. The muffler of claim 1, said inner workings further including:

(ii) a converging partition having a flow outlet, said converging partition disposed within said housing such that said exhaust gas introduced through said partition openings and into said interior of said dome-shaped partition passes through said flow outlet.

5. The muffler of claim 1, wherein said exhaust gas passing through said inlet opening is directed along a main flow path towards said outlet opening, and wherein said inner workings are adapted such that said main flow path flow is solely in a positive orientation.

6. The muffler of claim 1, wherein said inner workings are adapted such that any unidirectional flow regime within said housing bears solely a positive orientation.

7. The muffler of claim 1, wherein said base of said dome-shaped partition is equipped with an outlet partition having an exhaust gas outlet for fluidly sealing said base, such that said exhaust gas introduced into said interior is discharged solely through said exhaust gas outlet.

8. The muffler of claim 1, wherein $H_1$ is a height of said domed partition, and $H_2$ is a height of at least one opening of said at least two partition openings, and wherein a ratio of $H_1$ to $H_2$ is less than 5 to 1.

9. The muffler of claim 1, wherein $H_1$ is a height of said domed partition, and $H_2$ is a height of at least one opening of said at least two partition openings, and wherein a ratio of $H_1$ to $H_2$ is at least 1.5 to 1.

10. The muffler of claim 8, wherein said ratio is at least 2 to 1 and less than 4 to 1.

11. The muffler of claim 8, wherein said ratio is at least 2 to 1 and less than 3.5 to 1.

12. The muffler of claim 11, wherein said ratio is at least 2.5 to 1.

13. A muffler for receiving and discharging an exhaust gas from an internal combustion engine, the muffler comprising:

(a) a housing including:

(i) an inlet opening formed for a flow of exhaust gas into said housing, and (ii) an outlet opening formed for a discharge of exhaust gas from said housing; and (b) inner workings disposed within said housing, said inner workings including:

(i) a deflecting partition having an exterior surface, a first end of said exterior surface pointing toward said inlet opening, and widening out at a second end to form a base, said partition having at least two partition openings disposed between said first end and said second end of said exterior surface, wherein said partition is disposed within said housing such that substantially all of said exhaust gas passing through said inlet opening is deflected along said exterior surface and directed through said partition openings into an interior of said deflecting partition, before being discharged through said outlet opening, and wherein said exterior surface is substantially hemi-spherical.

14. A muffler for receiving and discharging an exhaust gas from an internal combustion engine, the muffler comprising:

(a) a housing including:

(i) an inlet opening formed for a flow of exhaust gas into said housing, and (ii) an outlet opening formed for a discharge of exhaust gas from said housing; and (b) inner workings disposed within said housing, said inner workings including:

(i) a deflecting partition having an exterior surface, a first end of said exterior surface pointing toward said inlet opening and widening out at a second end to form a base, said partition having at least two partition openings disposed between said first end and said second end of said exterior surface, wherein said partition is disposed within said housing such that substantially all of said exhaust gas passing through said inlet opening is deflected along said exterior surface and directed through said partition openings into an interior of said deflecting partition, before being discharged through said outlet opening, and wherein said exterior surface is substantially hemi-spheroidal.

15. The muffler of claim 14, wherein said openings are disposed in a side of said exterior surface.

16. The muffler of claim 14, wherein said exhaust gas passing through said inlet opening is directed along a main flow path towards said outlet opening, and wherein said inner workings are adapted such that said main flow path flow is solely in a positive orientation.

17. A muffler for receiving and discharging an exhaust gas from an internal combustion engine, the muffler comprising:

(a) a housing including:

(i) an inlet opening formed for a flow of exhaust gas into said housing, and (ii) an outlet opening formed for a discharge of exhaust gas from said housing; and (b) inner workings disposed within said housing, said inner workings including:

(i) a deflecting partition having an exterior surface, a first end of said exterior surface pointing toward said inlet opening, and widening out at a second end to form a base, said partition having at least two partition openings disposed between said first end and said second end of said exterior surface, wherein said partition is disposed within said housing such that substantially all of said exhaust gas passing through said inlet opening is deflected along said exterior surface and directed through said partition openings into an interior of said deflecting partition before being discharged through said outlet opening, and wherein $H_1$ is a height of said deflecting partition, and $H_2$ is a height of at least one opening of said at least two partition openings, and wherein a ratio of $H_1$ to $H_2$ is at least 1.5 to 1 and less than 5 to 1.

18. A muffler for receiving and discharging an exhaust gas from an internal combustion engine, the muffler comprising:

(a) a housing including:

(i) an inlet opening formed for a flow of exhaust gas into said housing, and (ii) an outlet opening formed for a discharge of exhaust gas from said housing; and (b) inner workings disposed within said housing, said inner workings including:

(i) a deflecting partition having an exterior surface, a first end of said exterior surface pointing toward said inlet opening, and widening out at a second end to form a base, said partition having at least two partition openings disposed between said first end and said second end of said exterior surface, wherein said partition is disposed within said housing such that substantially all of said exhaust gas passing through said inlet opening is deflected along said exterior surface and directed through said partition openings into an interior of said deflecting partition, before being discharged through said outlet opening, said inner workings further including a guide trough, disposed along said exterior surface, for guiding the flow of said exhaust gas along said exterior surface and towards said partition openings.

19. The muffler of claim 18, wherein $H_1$ is a height of said deflecting partition, and $H_2$ is a height of at least one opening of said at least two partition openings, and wherein a ratio of $H_1$ to $H_2$ is at least 1.5 to 1.

20. The muffler of claim 18, wherein said ratio is at least 2 to 1 and less than 4 to 1.

21. The muffler of claim 18, wherein said ratio is at least 2 to 1 and less than 3.5 to 1.

22. The muffler of claim 18, wherein said ratio is at least 2.5 to 1.

* * * * *